United States Patent [19]

Zeigler

[11] 4,026,313

[45] May 31, 1977

[54] COLLAPSIBLE SELF-SUPPORTING STRUCTURES

[76] Inventor: Theodore R. Zeigler, 2007 R St., NW., Washington, D.C. 20009

[22] Filed: July 13, 1976

[21] Appl. No.: 704,811

[52] U.S. Cl. ..... 135/4 R; 52/81; 52/109; 135/DIG. 3; 135/DIG. 9; 52/86

[51] Int. Cl.[2] ..... E04B 1/12; E04B 1/347

[58] Field of Search ..... 52/80, 81, 86, 109; 135/4, 1, 3 R, 3 E, DIG. 2, DIG. 3, DIG. 9

[56] References Cited

UNITED STATES PATENTS

| | | | |
|---|---|---|---|
| 2,928,403 | 3/1960 | Hoskins | 135/3 R |
| 3,053,351 | 9/1962 | Fulcher | 52/109 |
| 3,185,164 | 5/1965 | Pinero | 135/4 R |
| 3,375,624 | 4/1968 | Mikulin | 52/109 |
| 3,559,353 | 2/1971 | Partridge | 52/109 |
| 3,710,806 | 1/1973 | Kelly | 52/109 |
| 3,888,056 | 6/1975 | Kelly | 52/109 |
| 3,968,808 | 7/1976 | Zeigler | 52/81 |
| 3,973,370 | 8/1976 | McAllister | 52/81 |
| 3,986,519 | 10/1976 | Gillis | 135/3 E |

FOREIGN PATENTS OR APPLICATIONS

| | | | |
|---|---|---|---|
| 7,755 | 3/1914 | United Kingdom | 135/4 R |

*Primary Examiner*—Price C. Faw, Jr.
*Assistant Examiner*—Henry Raduazo
*Attorney, Agent, or Firm*—Snyder, Brown & Ramik

[57] ABSTRACT

Self-supporting structures and panels of diverse shapes are disclosed in which basic assemblies of crossed rod elements are employed to achieve the desired shape. Further, the crossing points of crossed rod elements in the structure involved may include limited sliding connections which effect transfer of collapsing force to other crossing points which are pivotally joined. An improved hub structure for pivotally joining ends of the rod elements at the outer and inner apical points is also disclosed.

10 Claims, 20 Drawing Figures

FIG. 7
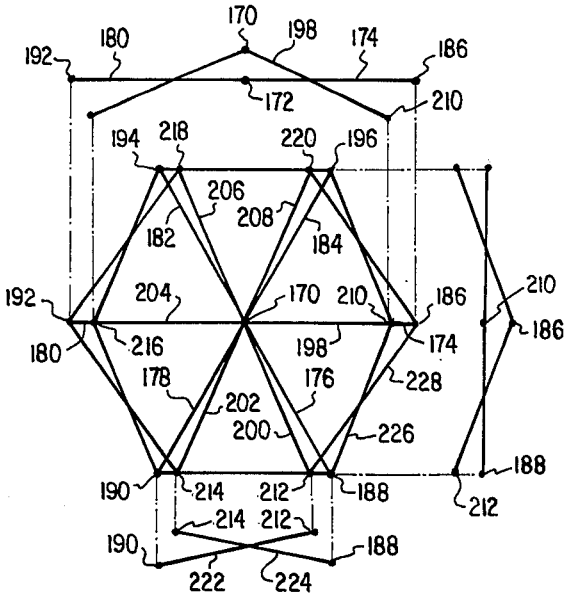
FIG. 10
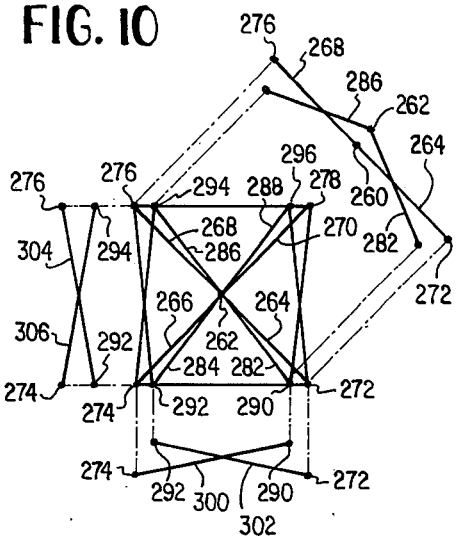
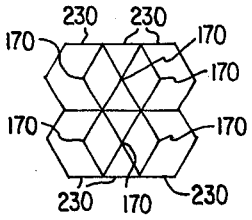
FIG. 8
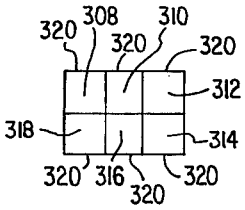
FIG. 11
FIG. 8A
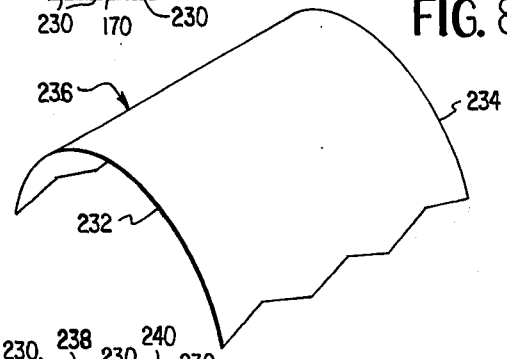
FIG. 11A
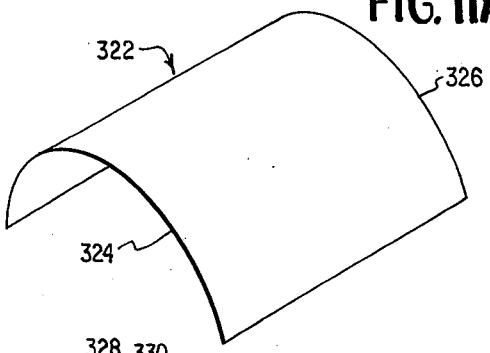
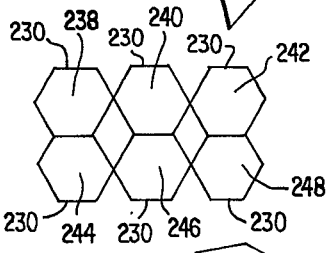
FIG. 9
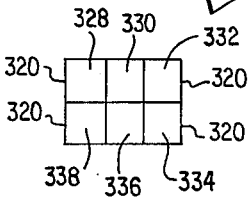
FIG. 12
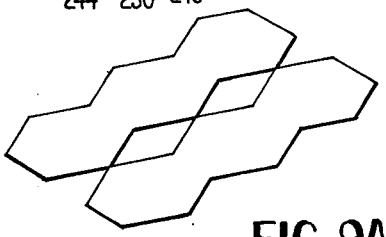
FIG. 9A
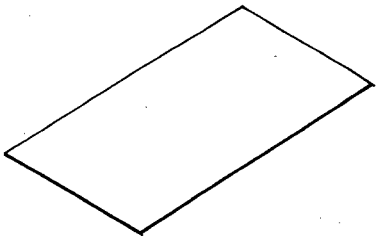
FIG. 12A FIG. 13
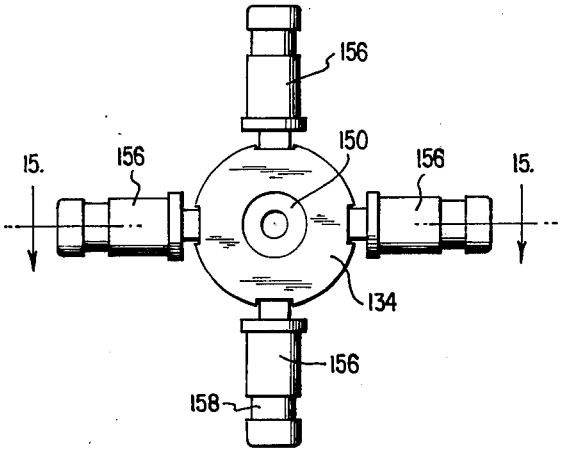
FIG. 14
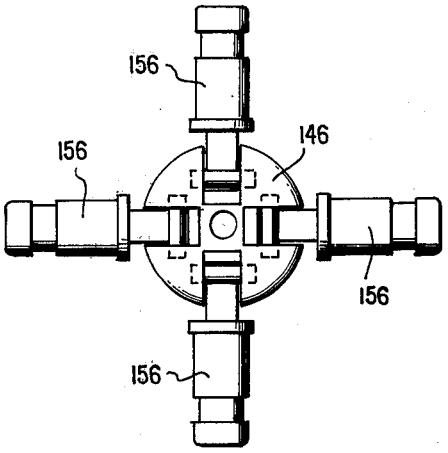
FIG. 15
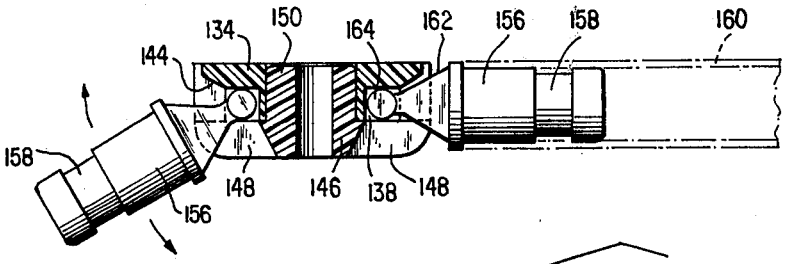
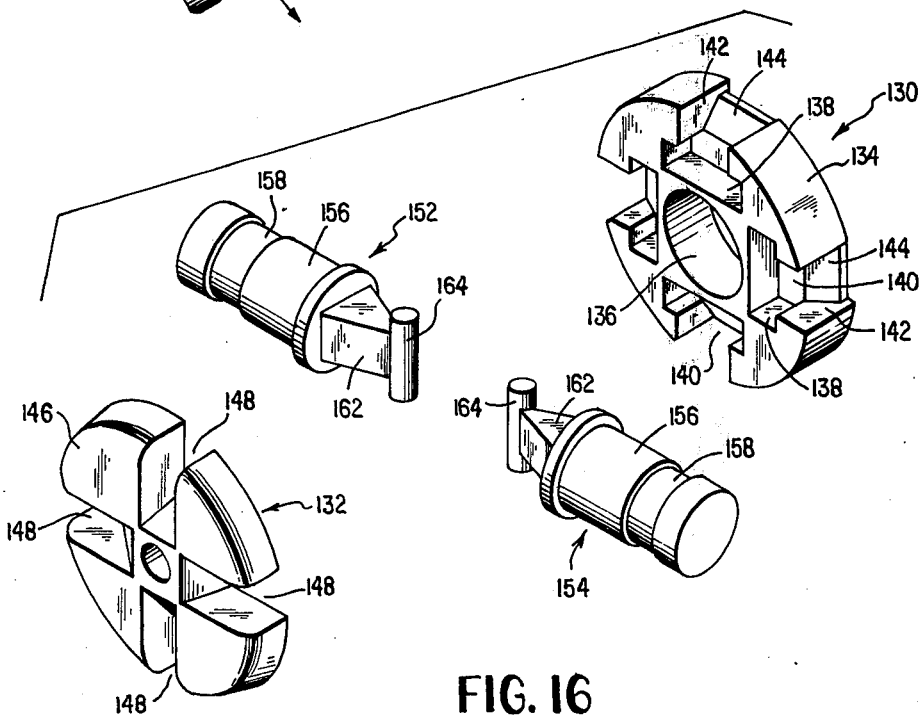
FIG. 16

COLLAPSIBLE SELF-SUPPORTING STRUCTURES

CROSS REFERENCE TO RELATED APPLICATION

This application is related to my copending application Ser. No. 521,472, filed Nov. 16, 1974 and which will issue as U.S. Pat. No. 3,968,808.

BACKGROUND OF THE INVENTION

In my aforesaid copending application, certain basic features of self-supporting structures are disclosed, and the disclosure of such application is incorporated herein by reference.

BRIEF SUMMARY OF THE INVENTION

The present invention is directed to collapsible, self-supporting structures having improved control of the elements during erection and collapse. Whether the structure is of spherical shape, arch-like shape or combination thereof, a better control of the various sections of the structure is achieved by alternating zones of fixedly pivoted and limited sliding crossed rod elements.

Another feature of the invention is concerned with the manner in which basic sub-assemblies of rod elements may be related to each other in order to control the shape of the structure involved. This is particularly advantageous when the collapsible structure is employed as a temporary wall or panel as, for example, in a room divider arrangement, a display panel, in an arrangement to provide a privacy enclosure, or in various similar arrangements.

Another feature of the invention resides in an improved hub construction for pivotally joining the ends of the rod elements to define the inner and outer apical points of the structure.

Various ways of achieving the limited sliding control of crossed rod elements and of achieving the fixed, pivotal connections thereof are disclosed.

BRIEF DESCRIPTION OF THE DRAWING FIGURES

FIG. 7 is a diagrammatic view illustrating one basic assembly of crossed rod elements;

FIG. 8 is a pattern diagram illustrating the lay up of assemblies of FIG. 7 required to produce an arch structure;

FIG. 8A is a view illustrating the arch structure achieved by the pattern of FIG. 8;

FIG. 9 is a pattern diagram illustrating the lay up of the basic assemblies of FIG. 7 required to produce a flat or planar structure;

FIG. 9A is a view illustrating the flat structure achieved by the pattern of FIG. 9;

FIG. 10 is a diagrammatic view illustrating another basic assembly of crossed rod elements;

FIG. 11 is a pattern diagram illustrating the lay up of basic assemblies of FIG. 10 required to produce an arch structure;

FIG. 11A is a view illustrating the arch structure achieved by the pattern of FIG. 11;

FIG. 12 is a pattern diagram illustrating the lay up of the basic assemblies of FIG. 10 required to produce a flat structure;

FIG. 12A is a view illustrating the flat structure achieved by the pattern of FIG. 12;

FIG. 13 is a top plan view of an improved hub construction;

FIG. 14 is a bottom plan view of the improved hub construction;

FIG. 15 is a section taken generally along the plane of action line 15—15 in FIG. 13; and FIG. 16 is an exploded perspective view of the improved hub.

DETAILED DESCRIPTION OF THE INVENTION

Figure 1:
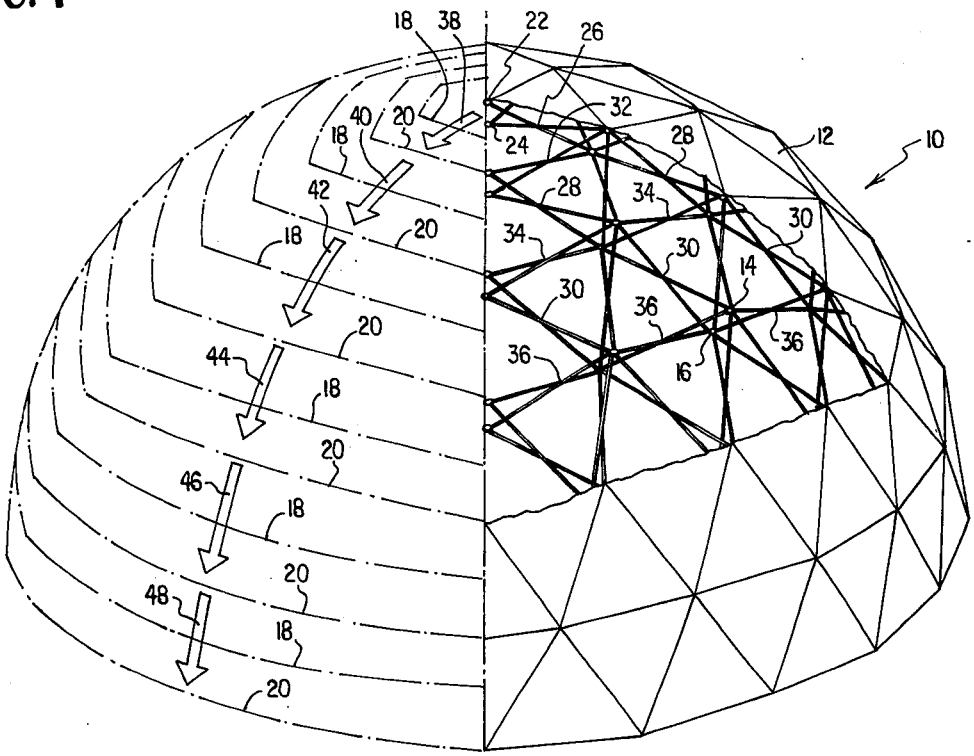
FIG. 1 is a diagrammatic perspective, partially in phantom line, illustrating a spherical structure to show the alternate sliding and fixed pivoting according to the invention.

With reference to FIG. 1, a spherical structure 10 is indicated generally therein, same being constructed in accord with the principles disclosed in my aforesaid copending application. The collapsible, self-supporting structure may have an outer skin or covering 12 as shown a portion of which has been broken away to reveal the underlying skeleton or structure. According to the aforesaid disclosure, the frame or skeleton is characterized by a series of radially aligned outer and inner apical points such as those indicated by the reference characters 14 and 16 respectively. The groups of rod elements which intersect at the various inner apical points are disposed substantially in a common plane when the structure is erected and the structure can be considered as made up of a series of scissors-like ladders of end-joined rod elements criss crossing each other and extending arch-like through the framework. In order to effect collapsing of the structure when desired, at least two points of each ladder, symmetrically spaced with respect to the center of the arch thereof have the crossing rod elements disposed in freely slidable relationship as is disclosed in my aforesaid copending application and to aid further in the collapsing certain of the rod elements may be left out of the structure, as is disclosed in my aforesaid copending application.

However, it is possible to utilize all of the rod elements in the structure while still achieving collapsing thereof by utilizing the principles disclosed herein. Specifically, this involves alternating zones of sliding and fixed pivotal crossing points of the rod-like elements. In FIG. 1, the limited or controlled sliding zones are indicated by reference characters 18 whereas the fixed pivotal crossing point zones are indicated by reference characters 20. It will be noted that these zones are concentric with respect to the pole defined by the outer and inner optical points 22 and 24 respectively with the crossing points such as are indicated by the reference character 26 being the first limited sliding crossing points corresponding to the uppermost zone 18. The crossing points 28 correspond to the next limited sliding zone 18, the crossing points 30 correspond to the next or third limited sliding zone 18 and so on through the structure, as will be apparent. The first fixed, pivotal zone 20 is defined by crossing points such as that indicated by the reference character 32, the next fixed, pivotal zone is defined by the crossing points indicated by the reference characters 34 and the third or next lower fixed, pivotal crossing point zone is defined by the crossing points as indicated by the reference characters 36, and so on throughout the structure.

The net effect on this arrangement is to achieve much better control both during erection and collapsing of structure and this is indicated diagrammatically by the arrows in FIG. 1. For example, upon the start of collapse of the structure as by pulling downwardly on the polar inner apical point 24, the crossing points 26 in the first zone 18 first allow the initial inward deflection of the inner apical point 24 and then, as will be set forth more particularly hereinafter, the limit of this sliding motion is reached and the collapsing force is now transmitted from the uppermost zone 18 directly to the first fixed, pivotal zone 20, as indicated by the arrow 38. As soon as this transfer of force occurs to the zone 20, the limited sliding action at the crossing points 28, corresponding to the second zone 18, commences and when that limited sliding action has reached its limit, the collapsing force is now transferred to the second fixed pivot zone 20 as indicated by the arrow 40. This action continues progressively from zone to zone as indicated by the remaining arrows 42, 44, 46 and 48, at which point the collapsing of the structure has been completed.

Figure 2:
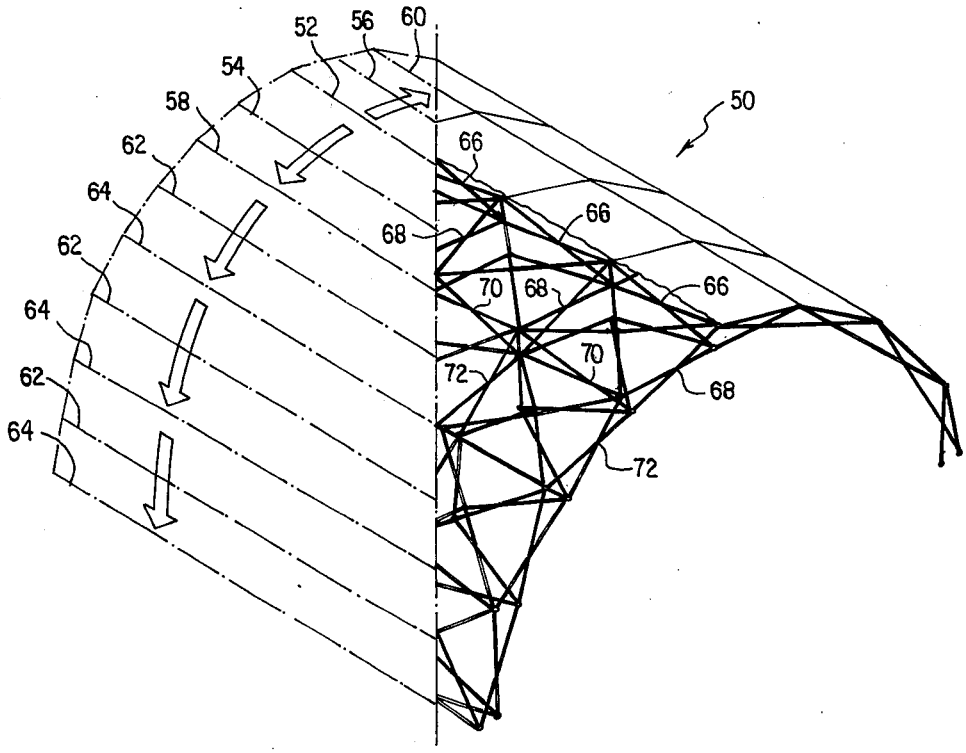
FIG. 2 is a view similar to FIG. 1 but illustrating the principle in connection with an arch shape structure.
Figure 3:
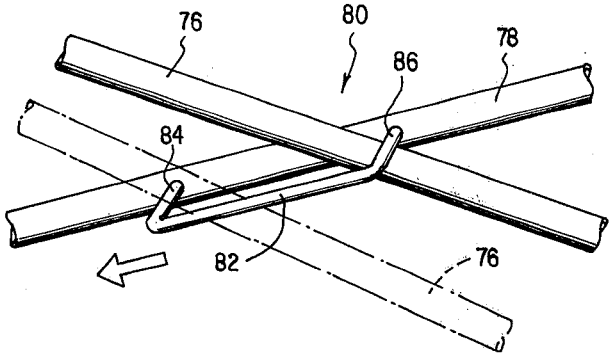
FIG. 3 is an enlarged perspective view illustrating one form of controlled sliding connection.
Figure 4:
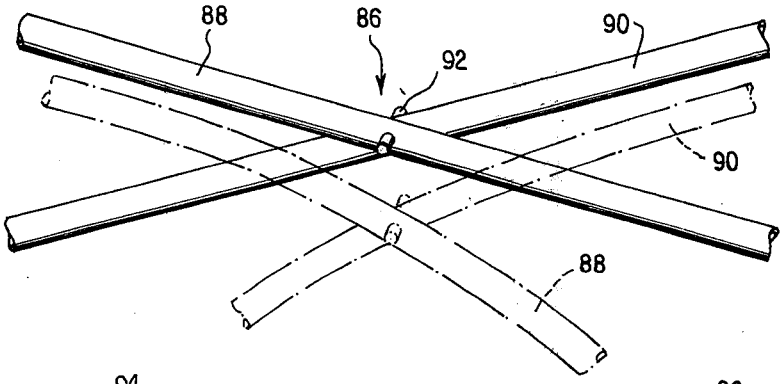
FIG. 4 is an enlarged perspective view illustrating one form of fixed, pivotal connection.

In the arch-like structure indicated in FIG. 2 by the reference character 50, a similar situation prevails as described above in connection with FIG. 1. However, in this case, the zones are parallel to the longitudinal axis of the structure. The zone which is uppermost and along the longitudinal spline of the structure 50, indicated by the reference character 52, is a zone of fixed pivotal connections whereas the next zones 54 and 56 on either side thereof are limited sliding zones, the next zones 58 and 60 being again the fixed, pivotal connection zones and so on throughout the structure where, in FIG. 2, the zones 62 are further zones of limited sliding motion whereas the zones 64 are fixed pivotal connection zones. To correlate the various zones with the crossing points in FIG. 2, the crossing points 66 correspond to the uppermost fixed pivotal connection zone 52 whereas the crossing points 68 correspond to the zone 54 and so on throughout the structure, the crossing points 70 corresponding to the zone 58, the crossing points 72 corresponding to the zone 62 and so forth. 78, A typical limited sliding crossing point arrangement is illustrated in FIG. 3 in detail. In that Figure, the two rod elements 76 and 78 which define the crossing point indicated generally by the reference character 80 are free to slide relative to each other through a limited extent by means of the bale-like stop member 82 fixed to the rod element 78. The two legs or stop portions 84 and 86 determined, by their spacing, the limited sliding motion which is permitted. Strictly speaking, the stop element 86 is not essential inasmuch as it is located at that point which corresponds to the self-supporting position of the rod elements of the entire framework or structure but the stop element 84 is essential in that it is this element which determines the limited sliding which is permitted between the two rod elements 76 and 78, the latter being indicated in phantom lines in its position during collapse wherein it is engaged against the stop member 84 to transfer the collapsing force to the next zone which would be a fixed, pivotal connection zone as for example as shown in FIG. 4. FIG. 4 shows the simplest form which the fixed, pivotal connection crossing point 86 may take. In this instance, the two rod elements 88 and 90 are simply pivotally joined together at the crossing point 86 by the fixed pin element 92 and during collapse, as is indicated by the phantom lines in FIG. 4, the rod elements 88 and 90 have sufficient resiliency to bow as indicated during the initial stages of collapse as to permit such collapsing action while transferring the collapsing force to the next zone of limited sliding motion.

Figure 5:
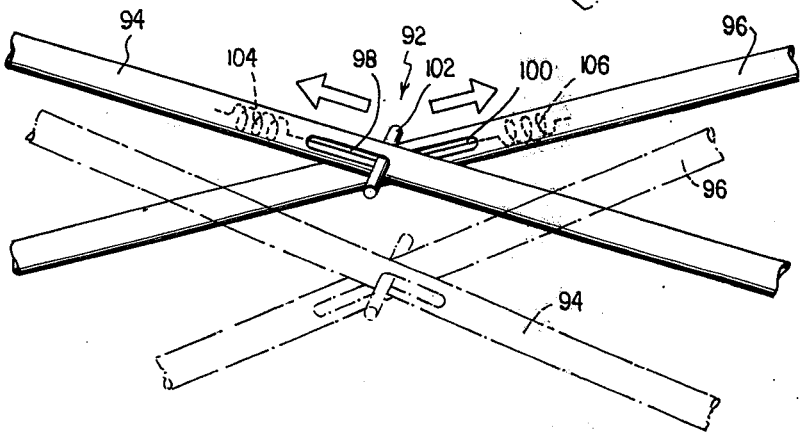
FIG. 5 is an enlarged perspective view illustrating another form of fixed, pivotal connection.

FIG. 5 shows an alternative form which the fixed, pivotal connection crossing point 92 may take. In this embodiment, provision is actually made for limited sliding motion of the two rod elements 94 and 96 because, in this instance, they are of heavy enough construction so that they will not conveniently bow sufficiently as in FIG. 4 to allow the collapse of the associated zone. Thus, the two rod elements 94 and 96 are provided with the elongate slots 98 and 100 and a spring tensioned pivot pin 102 passes through the two slots. Anchored in the rod element 94 is a tension spring element 104 which is hooked at its free end to the pin 102 to urge the same in one direction whereas the rod element 96 has one end of a tension spring 106 anchored thereto with its other or opposite free end being anchored to the pin 102 serving to urge this pin in the direction opposite to that in which the spring 104 acts. The full line position in FIG. 5 is the erected, self-supporting position and during collapse of the structure as is indicated in the phantom lines, the two rod elements 94 and 96 are in effect foreshortened to allow the collapse while at the same time transferring the collapsing force to the next limited sliding motion connection as in FIG. 3.

Figure 6:
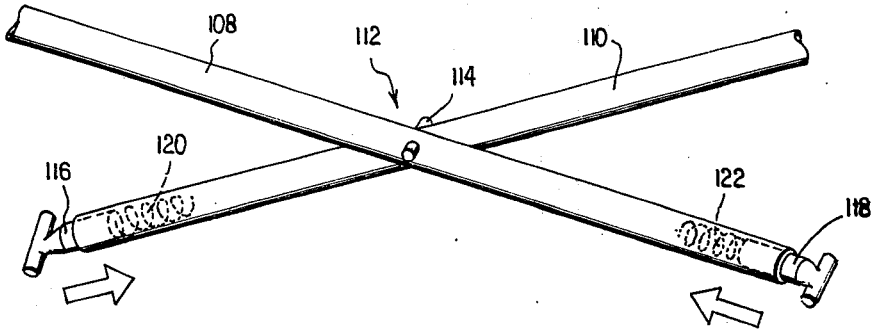
FIG. 6 is an enlarged perspective view illustrating still another form of fixed, pivotal connection.

FIG. 6 illustrates another form of fixed, pivotal crossing point connection as indicated at 112, again where the rod elements 108 and 110 are sufficiently stiff as to prevent the bowing action described in conjunction with FIG. 4. In this case, the two rod elements 108 and 110 are pivotally joined by the pin 114 but foreshortening of the two rod elements is permitted by means of the sliding hub connectors 116 and 118 which have shanks slidably received in the ends of the elements 108 and 110 as shown and acting therein against compression springs 120 and 122. It will be appreciated that all four ends of the two rod elements 108 and 110 can be provided with these spring biased hub connectors 116 and 118. However, it will also be appreciated that depending upon the particular construction involved, only one end of each pair of crossed rod elements may be provided with the spring biased hub connectors, exactly as shown in FIG. 6, or even only one end of rod element may be required to be provided with a spring biased hub connector.

An improved form of hub connector which provides inner and outer apical points of the framework is illustrated in FIGS. 13–16. As shown in FIG. 16, the hub proper comprises the top and bottom sections 130 and 132 respectively. The top structure is a disc-like body 134 which conveniently may be formed by conventional synthetic resin forming techniques and presents an enlarged central opening 136 which, on the inner or lower face there is provided a cluster of pivot pin-receiving recesses 138. Extending radially from each of the recesses 138 is a narrow slot 140 defined between surfaces such as those indicated by the reference character 142 and intersected by the angled or bevel surfaces 144. The lower member 132 is again of a disc-like body formation as indicated by reference character 146 provided with radial slots 148, as shown in FIG. 16 adapted to coincide with the slots 140. The body 146 is also provided with a central projecting boss 150, see particularly FIG. 15 which slip-fits into the central opening 136 of the upper portion 130 and which may be utilized to bond the two sections 130 and 132 together once the hub connectors such as those indicated by reference characters 152 and 154 in FIG. 16 are in place. The hub connectors are provided with shanks 156 provided with a circumferential groove 158. The shanks 156 are adapted to be slip-fitted into the ends of corresponding rod elements such as that indicated by reference character 160 in FIG. 15 and the rod element may be joined to the hub connector to prevent axial separation therebetween by locally crimping the wall of the rod element downwardly or inwardly into the circumferential groove 156. Preferably, this crimping action allows relative rotation between the hub connector and the rod element. Each hub connector includes a tapered end section 162 terminating in a cylindrical cross bar element 164, which cross bar elements 164 fit into the recesses 138 previously described in the top section 130 and with the parallel sides of the tapered sections 162 fitting in the slots 140.

The width of the tapered section 162 of each hub connector is such as snugly but slidably fits within the slot 142 associated therewith and the tapering of the section 162 allows the pivotal motion which is clearly indicated in FIG. 15.

Another aspect of the present invention is illustrated in FIGS. 7–12A. One basic arrangement or assembly of crossed rod elements is depicted in FIG. 7. The central portion of the Figure illustrates a plan view of the assembly whereas the various side projections are also illustrated. At the center of the arrangement is the outer apical point 170 and the corresponding inner apical point 172. From the inner apical point 172 six rod elements 174, 176, 178, 180, 182 and 184 radiate, lying substantially in a common plane to terminate at their opposite or free ends in the further outer apical points 186, 188, 190, 192, 194 and 196. Correspondingly, the six rod elements 198, 200, 202, 204, 206 and 208 extend from the outer apical point 170 to determine at their opposite or free ends in the corresponding further inner apical points 210, 212, 214, 216, 218 and 220.

On two diametrically opposite sides of the hexagonal configuration the two inner apical points, 212 and 214 on the one hand and the two inner apical points 218 and 220 on the other hand are disposed in more closely spaced relationship than their corresponding outer apical points 188 and 190 on the one hand and 194 and 196 on the other hand. These apical points are joined by a pair of crossed rod elements such as those indicated by the reference characters 222 and 224 in FIG. 7. The other remaining four sides of the hexagonal configuration have their inner and outer apical points spaced apart by the same distance and these likewise are joined by a pair of crossed rod elements such as the two rod elements 226 and 228 in FIG. 7. This basic arrangement may be laid out in a repeated pattern in the fashion indicated in FIG. 8 to produce an arch-like configuration as is illustrated diagrammatically in FIG. 8A. Simply stated, all of the hexagonal assemblies as shown in FIG. 7 are positioned with their outer apical central points 170 disposed outermost and they are also arranged so that their sides identified by reference characters 230 in FIG. 8 correspond to those sides in FIG. 7 in which the inner apical points such as 212 and 214 lie more closely spaced than the corresponding outer apical points 188 and 190. With such a repeating pattern prevailing throughout, the so-joined unequal apical point sides 230 will define the opposite end edges 232 and 234 of the arch-like structure indicated generally by the reference character 236 in FIG. 8A.

The same basic assembly of elements as shown in FIG. 7 may be arranged in a repeating pattern as illustrated in FIG. 9 to achieve an essentially flat partition or section. In FIG. 9, the pattern employs two rows of FIG. 7 assemblies as indicated by the reference characters 28, 240 and 242 for one row and as indicated by the reference character 244, 246 and 248 for the second row. The assemblies 238, 244, 242 and 248 all have their outer apical points 170 disposed on the same side, or outermost whereas the two assemblies 240 and 246 are arranged with their outer apical points on the opposite side or innermost. Also, the unequal spacing sides 230 are disposed as shown, basically in the same direction as was described in conjunction with FIG. 8. However, by the reversal of the directions of the two intermediate assemblies 240 and 246, a basically flat structural arrangement as is diagrammatically illustrated in FIG. 9 will prevail.

FIG. 10 shows another arrangement utilizing basically the same principles as is described in conjunction with FIGS. 7–9A. FIG. 10 of course corresponds generally to FIG. 7 and represents another arrangement or assembly of crossed rod elements. In this case, the inner apical point centrally disposed in the assembly is indicated by the reference character 260 whereas the outer apical point corresponding thereto is indicated by the reference character 262. With this configuration, four rod elements radiate essentially in a common plane from the inner apical point 262 and these are indicated by reference characters 264, 266, 268 and 270 and the outer ends of these rod elements define the corresponding outer apical points 272, 274, 276 and 278. Correspondingly, the four rod elements 282, 284, 286 and 288 extend from the outer apical point 262 and define at their free ends the correspondingly inner apical points 290, 292, 294 and 296.

Each of the four sides of the configuration or assembly of FIG. 10 is provided with a crossed pair or rod elements which join the four apical points in question. However, similarly as in FIG. 7, two of the diametrically opposite sides of the configuration of FIG. 10 are characterized by the fact that the inner apical points are more closely spaced than the outer apical points. Thus, in FIG. 10, the two inner apical points 290 and 292 and the two inner apical points 294 and 296 are more closely spaced than their corresponding outer apical points 272 and 274 and 276 and 278. On these unequally spaced sides, the corresponding apical points are joined by pairs of crossed rod elements such as those indicated by the reference characters 300 and 302. The remaining two sides have equally spaced inner and outer apical points as will be evident from FIG. 10 and these equal spacing sides have their inner and outer apical points joined by crossed pair of rod elements such as those indicated by reference characters 304 and 306 in FIG. 10.

FIG. 11 shows a pattern for forming the arch-like configuration of FIG. 11A from the assemblies of FIG. 10. In FIG. 11, six assemblies of FIG. 10 are shown and are indicated therein by the reference characters 308,

310, 312, 314, 316 and 318 and each is oriented with its outer central apical point 262 located uppermost, that is all on the same side and those sides 320 which have unequal spacing between the inner and outer apical points are oriented as shown. The corresponding arched structure formed by the lay-up according to FIG. 11 is produced, as indicated by reference character 322 with the opposite end edges 324 and 326 thereof corresponding to the unequal spacing sides 320 of the pattern in FIG. 11.

To form a flat partition or panel as illustrated in FIG. 12A, the lay-up according to the pattern of FIG. 12 is utilized. In FIG. 12, each assembly according to FIG. 10 is indicated by the reference characters 328, 330, 332, 334, 336 and 338. Again, as in FIG. 9, the four assemblies 328, 332, 334 and 338 are oriented with their outer apical points 262 on one side whereas the intervening assemblies 330 and 336 are oriented with their outer apical points 262 on the opposite side and with the unequal spacing sides 320 being oriented as shown, thereby producing an essentially flat structure according to FIG. 12A.

It will be appreciated of course that the curvilinear structures of FIGS. 8A and 11A may be combined with flat sections according to FIGS. 9A and 12A to provide any desired configuration of panel or partition or, a reverse curve configuration or any other configuration may be utilized as will be obvious. It is also to be noted that when these devices are to be utilized as for example room dividers or display panels or the like, they will be erected so as to rest upon the edges 232 and 324 of FIGS. 8A and 11A respectively so as otherwise to be standing in an upright position for the purposes intended.

Referring back to FIG. 7, it will be appreciated that for clarity of showing therein, the crossing points of the pairs of rod elements emanating from the inner and outer central apical points 170 and 172 are not illustrated. However, each such pair of cross rod elements as for example the rod elements 182 and 206 cross at their approximate midpoints to define crossing points as previously described. In order to achieve the unequal spacing between the inner apical points along the sides 230 and also to achieve the unequal spacing between the inner apical points 210 and 216 as compared to their corresponding outer apical points 186 and 192, there is a particular rule for the direction of the crossing of the rod elements. The rule is that going in a direction parallel to the sides 230, the rod element 202, for example, must be crossed to be inside the rod element 178 whereaas the rod element 200 must be crossed to be inside the rod element 176, that is, opposite the direction of crossing as between the rod elements 178 and 202. Continuing on, in the direction parallel to the sides 230, the next pair of crossed rod elements 226 and 228 must be crossed oppositely with respect to the crossing of the rod element 176 and 200, that is, with the rod element 226 crossing to the outside of the rod element 228, and so on throughout the structure. For those pairs of crossed rod elements which are parallel to or form the sides 230, the crossing direction for the lower side 230 must be opposite to that of the crossing direction of the opposite or top side 230 whereas the rods 174 and 198 must be crossed in the same direction as the rod elements for the top or upper side 230 and the rod elements 180 and 204 must be crossed in the same direction as the rod elements 222 and 224.

The crossing rule for FIG. 10 is that the four rods 282, 284, 286 and 288 must be crossed to the inside of their respective rods 264, 266, 268 and 270 whereas for all of the remaining crossed rod element around the periphery of the polygon, their crossing direction may be arbitrarily assigned so long as this same convention or arbitrary assignment is carried out for all of such crossed pairs around the periphery of the polygon. In any event, the crossing rule for each of the assemblies of FIGS. 7 and 10 is such that for the particular diameters of the rod elements and the lengths thereof, no rod element is required to be deflected from an essentially straight line in passing between the inner and outer apical points which it joins.

It will be further appreciated that for a closed structure as for example the structure shown in FIG. 1, provision must be made for limited sliding motion in order for the structure fully to collapse. However, with an open structure such as is shown in FIG. 2 wherein the ground engaging sides are not either tethered together or staked to the ground, but are free to move apart during collapsing, none of the pivot points need be provided with the limited sliding motion. Thus, when erecting privacy partitions or display panels or the like in accordance with FIGS. 7–12A, all of the crossing points of the rod element pairs may be pivotally joined and no limited sliding motion need be employed.

It will be further appreciated that the configuration shown in FIG. 2 utilizes the assembly of crossed rod elements as is illustrated in FIG. 10, and according to the pattern of FIG. 11 and it is contemplated of course also in FIG. 2 that provision must be made for the limited sliding motions in order to fully collapse the structure.

What is claimed:

1. A collapsible, self-supporting structure, comprising in combination:

a network of column - like elements freely pivotally joined together to form the self-supporting structure, there being groups of said elements which intersect and are freely pivotally joined at their ends to define inner and outer apical points, said outer apical points lying on the surface of revolution and said inner apical points being paired each with a corresponding outer apical point and being spaced inwardly from their corresponding outer apical points along radial lines normal to said surface of revolution;

therebeing at least three elements forming each of said groups which elements radiate from their corresponding apical points to join with other elements at other surrounding apical points, with those elements radiating from each inner apical point lying essentially in a common plane and radiating from such inner apical point to a plurality of surrounding outer apical points, whereby the network is characterized by a series of planes essentially within which lie elements radiating from and between a number of outer apical points;

each pair of corresponding inner and outer apical points having a plurality of pairs of elements which radiate therefrom and cross in scissors-like fashion;

there being first zones symmetrical with said surface of revolution defined by crossing points of certain of said pairs of elements and second zones symmetrical with said surface of revolution defined by crossing points of others of said pairs of elements, said first and second zones being disposed alternately throughout the structure; and first means for pivotally joining said certain pairs of elements and second means associated with said others of said pairs of elements for permitting a predetermined limited free sliding relation therebetween.

2. A collapsible, self-supporting structure as defined in claim 1 wherein said second means comprises a stop element on one element of each pair of said others of said pairs of elements.

3. A collapsible, self-supporting structure as defined in claim 1 wherein said second means comprises a U-shaped member anchored to one element of each of said others of said pairs of elements and arching over the other element of each pair.

4. A collapsible, self-supporting structure as defined in claim 1 wherein said first means includes means for allowing foreshortening of the rod elements.

5. A self-supporting structure which is also capable of being collapsed into compact form, comprising in combination:

a network of column-like elements freely pivotally joined together to form the self-supporting structure;

said elements being arranged in a plurality of sections which each are of polygonal plan view and said sections being joined together cumulatively to define the surface area of the self-supporting structure;

each section comprising at least three pairs of crossed elements radiating from a common center and defining inner and outer apical points at said common center and at the corners of the plan view polygon defined by each section, the elements of each section whose ends define the inner and outer apical points at said corners of each section being pivotally joined to the ends of elements of adjacent sections and those elements of each section which radiate from an inner apical point lying essentially in a common plane;

there being first zones symmetrical with said surface defined by crossing points of certain of said pairs of elements and second zones symmetrical with said surface of revolution defined by crossing points of others of said pairs of elements, said first and second zones being disposed alternately throughout the structure; and first means for pivotally joining said certain pairs of elements and second means associated with said others of said pairs of elements for permitting a predetermined limited free sliding relation therebetween.

6. A collapsible, self-supporting structure as defined in claim 5 wherein said second means comprises a stop element on one element of each pair of said other of said pairs of elements.

7. A collapsible, self-supporting structure as defined in claim 5 wherein said second means comprises a U-shaped member anchored to one element of each of said others of said pairs of elements and arching over the other element of each pair.

8. A collapsible, self-supporting structure as defined in claim 5 wherein said first means includes means for allowing foreshortening of the rod elements.

9. A collapsible, self-supporting structure, comprising in combination:

a network of column-like elements freely pivotally joined together to form the self-supporting structure, there being groups of said elements which intersect and are freely pivotally joined at their ends to define inner and outer apical points, said outer apical points lying on a surface of revolution and said inner apical points being paired each with a corresponding outer apical point and being spaced inwardly from their corresponding outer apical points along radial lines normal to said surface of revolution;

there being at least three elements forming each of said groups which elements radiate from their corresponding apical points to join with other elements at other surrounding apical points, with those elements radiating from each inner apical point lying essentially in a common plane and radiating from such inner apical point to a plurality of surrounding outer apical points, whereby the network is characterized by a series of planes essentially within which lie elements radiating from and between a number of outer apical points;

each pair of corresponding inner and outer apical points, having a plurality of pairs of elements which radiate therefrom and cross in scissorslike fashion;

there being first zones symmetrical with said surface of revolution defined by crossing points of certain of said pairs of elements and at least one second zone symmetrical with said surface of revolution defined by crossing points of others of said pairs of elements; and first means pivotally joining said certain pairs of elements and second means associated with said others of said pairs of elements permitting a predetermined free sliding relation therebetween whereby during collapse of said structure said second means transfers collapsing force to at least one of said first zones upon reaching the limit of sliding motion.

10. A self-supporting structure which is also capable of being collapsed into compact form, comprising in combination:

a network of column-like elements freely pivotally joined together to form the self-supporting structure;

said elements being arranged in a plurality of sections which each are of polygonal plan view and said sections being joined together cumulatively to define the surface area of the self-supporting structure;

each section comprising at least three pairs of crossed elements radiating from a common center and defining inner and outer apical points at said common center and at the corners of the plan view polygon defined by each section, the elements of each section whose ends define the inner and outer apical points at said corner of each section being pivotally joined to the ends of elements of adjacent sections and those elements of each section which radiate from an inner apical point lying essentially in a common plane;

there being first zones symmetrical with said surface defined by crossing points of certain of said pairs of elements and at least one second zone symmetrical with said surface of revolution defined by crossing points of others of said pairs of elements; and first means pivotally joining said certain pairs of elements and second means associated with said others of said pairs of elements permitting a predetermined free sliding relation therebetween whereby during collapse of said structure said second means transfers collapsing force to at least one of said first zones upon reaching the limit of sliding motion.

* * * * *